US005699683A

United States Patent [19]

Rieker

[11] Patent Number: 5,699,683

[45] Date of Patent: Dec. 23, 1997

[54] FILTER SLEEVE FOR TUBULAR FILTER CORE

[75] Inventor: Gerd Rieker, Troy, N.Y.

[73] Assignee: Sonoco Products Company, Inc., Hartsville, S.C.

[21] Appl. No.: 663,825

[22] Filed: Jun. 14, 1996

[51] Int. Cl.[6] ..... D06B 5/18; B65H 75/22

[52] U.S. Cl. ..... 68/198; 156/73.3; 156/218; 156/304.2; 156/304.6; 210/497.01; 242/118.11

[58] Field of Search ..... 68/198; 242/118.1, 242/118.11, 118.2; 219/489, 497.01; 156/73.3, 218, 304.2, 304.6

[56] References Cited

U.S. PATENT DOCUMENTS

| | | |
|---|---|---|
| 173,419 | 2/1876 | Potter . |
| 341,633 | 5/1886 | Barker . |
| 534,960 | 2/1895 | Kennedy et al. . |
| 885,472 | 4/1908 | Hegarty . |
| 929,885 | 8/1909 | Rush . |
| 952,226 | 5/1910 | Bangle et al. . |
| 1,332,330 | 3/1920 | Gammeter . |
| 1,392,321 | 10/1921 | Gammeter . |
| 1,459,241 | 6/1923 | Norström . |

(List continued on next page.)

FOREIGN PATENT DOCUMENTS

| | | |
|---|---|---|
| 166744 | 4/1934 | Switzerland . |
| 332112 | 10/1958 | Switzerland . |

*Primary Examiner*—Philip R. Coe
*Attorney, Agent, or Firm*—Seidel, Gonda, Lavorgna & Monaco, PC

[57] ABSTRACT

A yarn carrier is provided of the type including a substantially rigid tubular core having passageways through the sidewall thereof for the passage of dye or wet finishing bath into the yarn to be wrapped thereon. A filter sleeve is wrapped around the outer surface of the tubular core to prevent entrapment of the yarn in the passageways and for filtering the dye and/or finishing bath. The filter sleeve is formed from a filter material which is wrapped into a sleeve and abutting edges of the filter material are bonded together along a seam. The seam is contemplated to be substantially continuous and extend the length of the sleeve. The tubular sleeve is slid over or heat shrunk onto the outside surface of the tubular core prior to the winding of the yarn thereon.

15 Claims, 1 Drawing Sheet

U.S. PATENT DOCUMENTS

| | | | |
|---|---|---|---|
| 1,558,264 | 10/1925 | Hathaway . | |
| 1,589,533 | 6/1926 | Hubbard . | |
| 1,641,142 | 8/1927 | Johnson | 428/255 |
| 1,652,601 | 12/1927 | Blair | 242/118.3 |
| 1,851,659 | 3/1932 | Bodine . | |
| 1,990,860 | 2/1935 | Ellsworth . | |
| 2,065,299 | 12/1936 | Atwood . | |
| 2,085,093 | 6/1937 | Gauthier | 242/586.1 |
| 2,138,568 | 11/1938 | Brandenberger . | |
| 2,171,890 | 9/1939 | Precourt . | |
| 2,191,108 | 2/1940 | Huttinger . | |
| 2,260,452 | 10/1941 | Hart . | |
| 2,384,462 | 9/1945 | Goodman . | |
| 2,452,378 | 10/1948 | Hudson . | |
| 2,566,431 | 9/1951 | Steiding et al. . | |
| 2,585,999 | 2/1952 | Bunch | 242/610.6 X |
| 2,635,330 | 4/1953 | Fentress . | |
| 2,645,554 | 7/1953 | De Vault et al. . | |
| 2,689,097 | 9/1954 | Carris | 242/118.4 |
| 2,767,741 | 10/1956 | Knowland et al. | 242/118.32 |
| 2,948,487 | 8/1960 | Locklin . | |
| 3,106,725 | 10/1963 | Stiner et al. . | |
| 3,278,135 | 10/1966 | Black . | |
| 3,289,973 | 12/1966 | Spencer . | |
| 3,471,350 | 10/1969 | O'Berry et al. | 242/118.32 X |
| 3,544,034 | 12/1970 | Jurney | 242/118.32 |
| 3,554,461 | 1/1971 | Boutonnet | 242/118.11 |
| 3,578,258 | 5/1971 | Heine et al. | 242/74.1 |
| 3,657,033 | 4/1972 | Sager | 156/73.3 |
| 3,672,598 | 6/1972 | Saveth | 242/118.2 |
| 3,713,601 | 1/1973 | Buhrman et al. | 242/68.6 |
| 3,756,530 | 9/1973 | Ito et al. | 242/118.2 |
| 3,842,866 | 10/1974 | Miller | 138/128 |
| 3,851,838 | 12/1974 | Biggs, Jr. et al. | 242/118.32 |
| 3,899,075 | 8/1975 | Hall et al. | 206/411 |
| 3,980,249 | 9/1976 | Cunningham et al. | 242/118.31 |
| 4,026,690 | 5/1977 | McClellan | 242/118.32 X |
| 4,298,122 | 11/1981 | Ekelund | 242/125.1 X |
| 4,371,129 | 2/1983 | Schulz | 242/118.7 |
| 4,390,144 | 6/1983 | Mueller | 242/118.3 |
| 4,471,919 | 9/1984 | Leunig | 242/115 |
| 4,545,833 | 10/1985 | Tafara | 210/497.01 X |
| 4,621,508 | 11/1986 | Baxley, Jr. et al. | 242/118.11 X |
| 4,637,233 | 1/1987 | Tanaka et al. | 242/118.1 X |
| 4,899,414 | 2/1990 | Irwin | 15/97 B |
| 4,969,999 | 11/1990 | Riddell | 210/497.01 |
| 5,094,404 | 3/1992 | DesRosiers et al. | 242/118.11 |
| 5,131,595 | 7/1992 | Romagnoli | 242/118.1 |
| 5,293,935 | 3/1994 | Arterbury et al. | 210/497.01 X |
| 5,348,052 | 9/1994 | Crane et al. | 138/174 |

FIG. 1
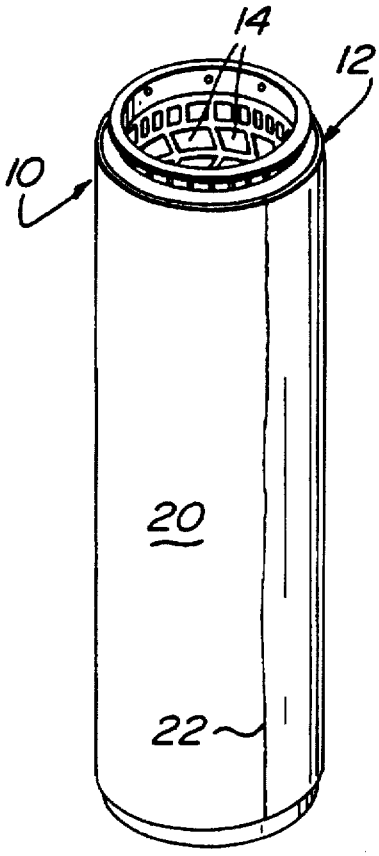
FIG. 2
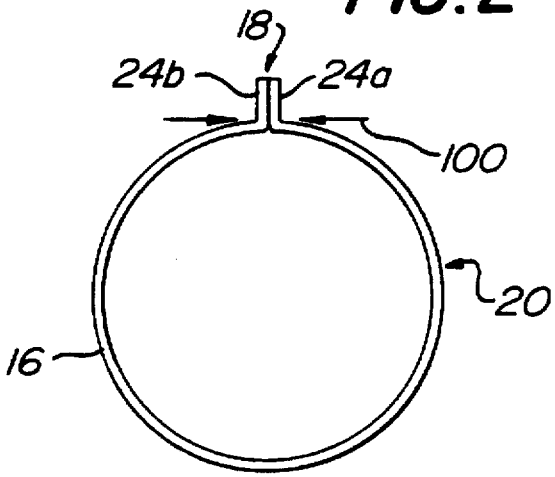
FIG. 3
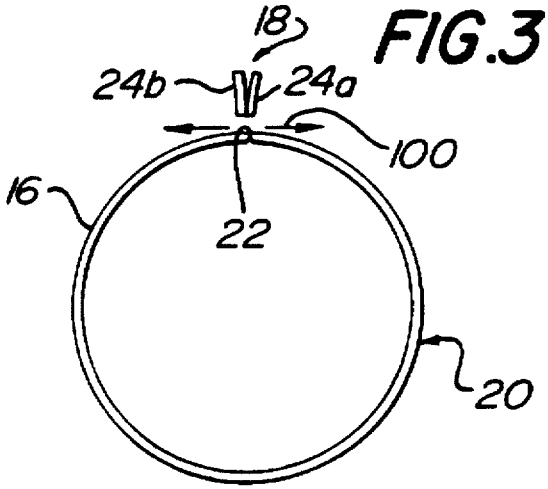
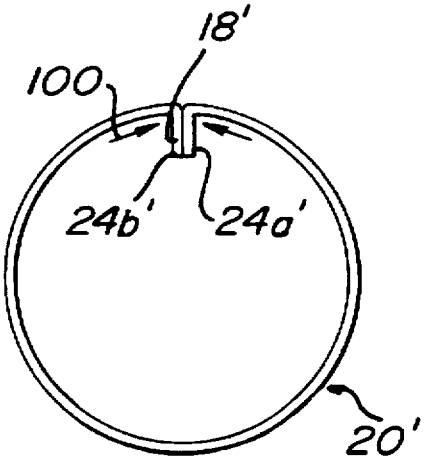
FIG. 4
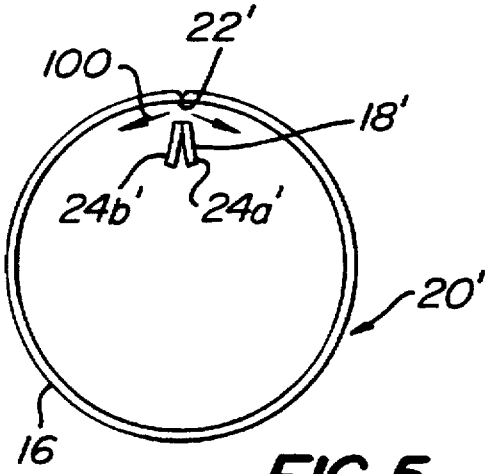
FIG. 5

FILTER SLEEVE FOR TUBULAR FILTER CORE

BACKGROUND OF THE INVENTION

The present invention relates to the formation of a tubular filter materials into a sleeve for purposes of placement on a hollow tubular core having openings therein. The filter sleeve is formed from the filter material by bonding abutting edges together to form a seam.

One application for the present invention is a tubular yarn carrier used for dyeing or wet finishing of textile yarn. Such textile yarn carriers are typically known as "dye tubes" or "dye springs". Both include a tubular structure having a series of openings therein for passage of dye or other agents in the processing yarn wound on the outside surface thereof. A filter sleeve is typically provided between the tube and the yarn to prevent entrapment of the yarn in the passageways of the tube and for providing filtration of the dye or the like being applied to the yarn.

Other rigid and semi-rigid type filter tubes may be used along with the features of the present invention.

SUMMARY OF THE INVENTION

The present invention is defined as the combination of a tubular filter core, and is preferably in the form of a textile yarn carrier such as for use in dyeing or wet finishing textile yarn, and a filter sleeve. The filter core includes a hollow tubular structure having a plurality of passageways through the sidewall thereof. The filter sleeve is wrapped around the outer surface of the tubular core. The filter sleeve includes a seam created by the bonding together of abutting edges of the filter material. The sleeve is then slid over the outside surface of the filter core.

Additional features and advantages of the invention will become apparent to those skilled in the art upon consideration of the following detailed description of the preferred embodiment exemplifying the best mode of carrying out the invention as presently perceived. The detailed description particularly refers to the accompanying drawings.

BRIEF DESCRIPTION OF THE DRAWINGS

FIG. 1 is a perspective view of a textile yarn carrier in accordance with the present invention.

FIG. 2 is a side schematic view of a first portion of the seam forming operation for the sleeve portion of the textile yarn carrier of FIG. 1.

FIG. 3 is a side schematic view of a second portion of the seam forming operation of FIG. 2.

FIG. 4 is a side schematic view of a first portion of an alternate seam forming operation.

FIG. 5 is a schematic view of a second portion of the seam forming operation of FIG. 4.

DETAILED DESCRIPTION OF THE DRAWINGS

In the drawings where like numerals identify similar elements, there is shown a form of the invention which is presently preferred. In FIG. 1 there is shown a textile yarn carrier which is generally designated by the numeral 10. The yarn carrier 10 of the type shown is contemplated to be used in dyeing or wet finishing textile yarn (not shown). The yarn carrier 10 provides support for yarn (not shown) which is to be wound thereon. The yarn carrier may be in the form shown and described in U.S. Pat. No. 4,621,508, which is herein incorporated by reference.

The yarn carrier 10 includes a substantially rigid tubular core 12 having passageways 14 through the sidewall thereof for the passage of dye or other wet finishing baths. Preferably, the tubular core 12 is constructed of a reclaimable material, such as molded polypropylene or the like.

The yarn carrier 10 includes a tubular filter sleeve 20 which is disposed around the outside surface of the tubular core 12. Sleeve 20 provides filtration of the dye or other wet finishing baths. The filter sleeve 20 has a length which is sufficient to cover the passageways 14 in the tubular core 12. Preferably, the filter sleeve 20 is constructed from a spun bonded non-woven polypropylene material. Other materials may be used and are contemplated by the present invention. The advantages of using a polypropylene filter sleeve and yarn carrier are described in U.S. Pat. No. 4,621,508, identified above.

The filter sleeve 20 includes a seam 22 which, as illustrated, extends parallel to the longitudinal axis of the tubular core 12. It should be understood, however, that the seam 22 could also extend obliquely or helically along the length of the tubular core 12.

Referring now to FIGS. 2 and 3, there is schematically shown end views of a seam forming operation for a tubular sleeve 20. The sleeve material 16 is contemplated to be provided in sheet form. The sleeve material 16 is folded and formed into a tubular shape. This folding operation may be performed around a mandrel or the like (not shown). When folded, the opposing edges **24*a* and 24*b* of the sheet 16 are positioned adjacent one another, with the face of each edge of the sheet being in contact. As illustrated, the edges 24*a*, 24*b* form an outwardly projecting tab 18. A bonding tool 100 (shown schematically by arrows) is brought into contact or near contact with the outside surfaces of tab 18. The tool 100 fuses or bonds the edges 24*a*, 24*b* together to form the tubular sleeve 20. Bonding is contemplated to be performed by a heat welding process or an ultrasonic welding process. The bonding fuses the edges 24*a*, 24*b* together and forms the seam 22. As shown in FIG. 3, the bonding operation also preferably separates the remaining portion of tab 18 from the tubular sleeve portion. The seam preferably extends for the entire length of the sleeve 20**.

The fused edges of the filter material along seam 22 abut against each other to form the tubular sleeve 20. The abutting edges include almost no overlap and create the appearance of a continuous outer surface for the sleeve 20. Although the seam 22 is identifiable upon inspection, the bonding or fusing of abutting edges is contemplated to create a substantially smooth surface. In contrast, the edges of conventional carrier sleeves overlap along the seam. These overlapping edges are more susceptible to "dog ears" caused by a separated or inadequate bond and, thus, may cause obstacles to delivery of yarn to or from the carriers. The seam of the present invention is contemplated to limit the formation of such obstacles during use of the yarn carrier.

In FIGS. 4 and 5, there is shown another embodiment of the present invention. In this embodiment, which is presently preferred, the edges **24*a*' and 24*b*' of the sleeve material 16 are wrapped inwardly. Thus, the tab 18' extends radially inwardly from the inner surface of the tubularly shaped sleeve 20'. A mandrel (not shown) having a channel or groove therein may be used to form the tubular sleeve 20'. The channel retains or supports the inwardly projecting adjoining faces of the edges 24*a*', 24*b*' of the filter material. The bonding tool 100 fuses the adjacent edges 24*a*', 24*b*' of the sleeve material 16, such that the seam 22' is formed on the inner surface of the tubular sleeve 20'. This inner seam 22' secures the bonded edges in an abutting relationship, similar to the seam 22 formed in FIGS. 2 and 3. It is contemplated that the inside seem 22' results in a relatively smoother surface as compared to the outer seam 22' in the embodiment of FIGS. 2 and 3. Again, the bonding process, preferably, separates the portions of the edges 24a', 24b'** that extend beyond the seam.

The seam of the present invention is formed with abutting edges of the sleeve material bonded together. Tubular sleeve 20 or 20' formed in this manner can be stretched over the tubular core 12 and positioned as shown in FIG. 1. The bonding of the sleeve material must be sufficient to withstand the tensile load created by this stretching process. The bond must also be sufficient to retain the sleeve on the core after the dyeing and finishing steps are completed and as the thread is unwound therefrom.

Due to the tension in the sleeve, upon being stretched over the tubular core, it is contemplated that no further attachment of the sleeve to the core is required. However, such attachment may be utilized as desired. It is also possible to heat shrink the sleeve onto the tubular core to provide appropriate fit without attachment. In some situations, it may be advantageous to have this sleeve not attached to the core. The unattached sleeve may be more easily removed from the core during recycling, particularly if the sleeve and core are of different materials.

The embodiments described above have particularly referenced a yarn carrier, such as a dye tube or dye spring. However, it is contemplated that other types of filter cores or supports may be provided with the filter sleeve. Moreover, it is contemplated that multiple layers of filter material may be provided with the sleeve.

The present invention may be embodied in other specific forms without departing from the spirit or essential attributes thereof and, accordingly, reference should be made to the appended claims, rather than to the foregoing specification, as indicating the scope of the invention.

What is claimed is:

1. A textile yarn carrier for use in dyeing or wet finishing textile yarn comprising:

a hollow tubular core having passageways through the sidewall thereof, and a filter material wrapped around the outer circumference of the tubular core, the filter material formed into a sleeve, the sleeve having a seam formed by a bond between abutting edges of the filter material.

2. The textile yarn carrier according to claim 1, wherein the seam is located on the outer surface of the filter sleeve.

3. The textile yarn carrier according to claim 1, wherein the seam is located on the inner surface of the filter sleeve.

4. The textile yarn carrier according to claims 1, 2 or 3, wherein the seam is formed by ultrasonic welding of the edges of the filter sleeve together.

5. The textile yarn carrier according to claim 4, wherein the tubular core comprises molded polypropylene material and the filter material comprises spun-bonded non-woven polypropylene material.

6. The textile yarn carrier as claimed in claim 4, wherein the seam is continuous along the abutting edges of the filter material.

7. The textile yarn carrier claimed in claim 4, wherein the seam is formed along the entire length of the sleeve.

8. A filter sleeve adapted to be disposed around the outer circumferential surface of a tubular textile yarn carrier, the sleeve comprising:

a sheet of filter sleeve material formed into a tubular shape having a diameter slightly less than the diameter of the tubular yarn carrier, on which it is to be placed, the edges of the filter sheet positioned in an abutting relationship and bonded together to form a seam, the tubular sleeve having a substantially smooth and continuous outer surface.

9. The filter sleeve according to claim 8, wherein the seam is formed on the outer surface of the tubular filter material.

10. The filter sleeve according to claim 8, wherein the seam is formed on the inner surface of the tubular filter material.

11. The filter sleeve according to claims 9 or 10, wherein the seam is formed by heat bonding the abutting edges of the filter material.

12. The filter sleeve according to claims 9 or 10, wherein the seam is formed by ultrasonic welding of the abutting edges of the filter material.

13. The filter sleeve according to claim 8, wherein the sleeve comprises a spun-bonded non-woven polypropylene material.

14. A textile yarn carrier for use in dyeing or wet finishing textile yarns comprising:

a hollow tubular core having passageways through the side wall thereof, a filter disposed around the outer circumferential surface of the tubular core, the sleeve comprising a sheet of filter material formed into a tubular shape having a diameter slightly less than the diameter of the filter core on which it is to be placed, the edges of the filter sheet positioned in an abutting relationship and bonded together to form a seam, the filter sleeve having a substantially smooth and continuous outer surface.

15. The textile yarn carrier according to claim 1, wherein the tubular filter material has a substantially smooth and continuous outer surface.

* * * * *